US005257655A

United States Patent [19]

Skendzel

[11] Patent Number: 5,257,655

[45] Date of Patent: Nov. 2, 1993

[54] PROCESS FOR TREATING WOOD

[76] Inventor: Gary Skendzel, P.O. Box 236, Berthoud, Colo. 80513

[21] Appl. No.: 949,458

[22] Filed: Sep. 22, 1992

[51] Int. Cl.[5] ..... B27M 1/00; B24C 1/00

[52] U.S. Cl. ..... 144/358; 51/319; 51/320; 144/361

[58] Field of Search ..... 428/170; 51/319, 320; 144/358, 361

[56] References Cited

U.S. PATENT DOCUMENTS

| | | | |
|---|---|---|---|
| 649,978 | 5/1900 | Buyten | 144/358 |
| 2,345,942 | 4/1944 | Lehman | 144/358 |
| 4,821,461 | 4/1989 | Holmstrand | 51/319 |

*Primary Examiner*—W. Donald Bray
*Attorney, Agent, or Firm*—Dean P. Edmundson

[57] ABSTRACT

A process for treating wood to simulate driftwood or to create a weathered appearance. The process involves impacting the surface of the wood with glass beads sufficiently to cause the soft rings to wear away at a rate greater than the hard rings.

5 Claims, 1 Drawing Sheet

PROCESS FOR TREATING WOOD

FIELD OF THE INVENTION

This invention relates to processes and techniques for treating wood. More particularly, this process relates to processes and techniques for treating wood to give it a weathered appearance.

BACKGROUND OF THE INVENTION

Wood is commonly used for framing artwork, photographs, plaques, clocks and other decorative items. Sometimes the wood is sanded and stained to provide a smooth finish with a high gloss. Some people prefer to sand the wood to make it smooth and then paint it.

A particularly attractive type of wood for use in artwork or in frames around artwork, photographs, clocks, etc. is driftwood. This type of wood is very attractive because it has been naturally weathered by the environment. When wood is weathered naturally it takes on a grooved or roughened appearance. This is because the wood includes rings or sections which are of different hardness which are weathered at different rates upon exposure to the environment. The naturally occurring rings in the wood alternate between relatively hard (resulting from the cold season) and relatively soft (resulting from the warm season). During natural weathering, the soft rings are eroded away at a faster rate than the hard rings. As a result, the hard rings form ridges and the softer rings are weathered to leave grooves or depressions between the hard rings.

Because the supply of naturally occurring driftwood is limited, it would be advantageous to have a technique for modifying ordinary wood to simulate the appearance of driftwood. Some have tried using the technique of sandblasting ordinary wood to modify its appearance. However, the result is not entirely satisfactory because the sand tends to wear away the wood in a manner such that both the hard rings and soft rings are worn down. Although a rough surface remains, it does not simulate driftwood in appearance. The sand tends to pit the wood and that is undesirable.

SUMMARY OF THE PRESENT INVENTION

In accordance with the present invention there is provided an effective and reliable process for treating wood (especially pine) to simulate naturally occurring driftwood or to create a weathered appearance. The process comprises impacting the wood with glass beads at a speed and for a time sufficient to wear away (i.e., abrade) the soft rings in the wood at a rate greater than the hard rings in the wood.

Preferably the glass beads are carried in a stream or jet of pressurized air which is directed at the surface of the wood to be treated. In one embodiment the air pressure is preferably in the range of about 40 to 200 psi (more preferably 80 to 175 psi).

The glass beads impact on the surface of the wood and wear away the soft rings at a rate greater than the hard rings. The resulting appearance of the wood is very attractive and is remarkably similar to naturally occurring driftwood.

The resulting grooved surface is not pitted. Rather, the surface of the wood remains smooth. The surface can be left natural or it may be oiled or stained and then protected with a clear lacquer coating. It is also possible to burn the surface of the wood, if desired, to assist in bringing out the grain. Then the surface can be oiled or stained and covered with clear lacquer.

BRIEF DESCRIPTION OF THE DRAWINGS

The invention is described in more detail hereinafter with reference to the accompanying drawings, wherein like reference characters refer to the same parts throughout the several views and in which.

DETAILED DESCRIPTION OF THE INVENTION

The process of the invention is illustrated in the accompanying drawings. A block or piece of wood 10 to be treated comprises alternating hard rings 12 and soft rings 14. The hard rings are caused by cold seasons and the soft rings are caused by warm seasons.

Figure 2:
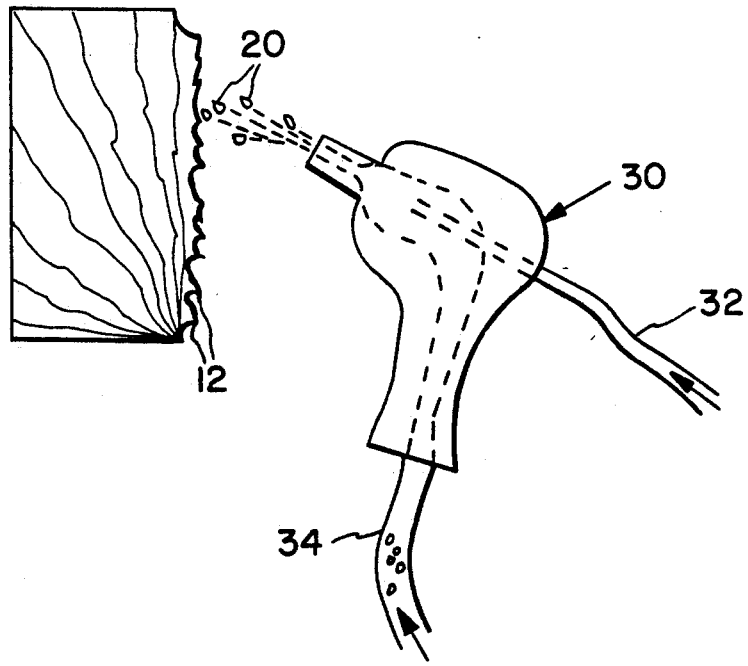
FIG. 2 is a side elevational view illustrating one mode of the process of the invention.

Glass beads 20 are directed against the surface of the wood at high speed. Preferably the beads are propelled against the wood surface by means of a jet or stream of pressurized air. A convenient manner of doing this is by means of a conventional mixing gun 30, as shown in FIG. 2. A line 32 supplying pressurized air is connected to the gun. Another line 34 supplying glass beads is also connected to the gun. The pressurized air passing through the gun creates suction in line 34 to draw the beads into the gun where they are mixed with the pressurized air and then forced out of the nozzle.

Preferably the air pressure used is in the range of about 40 to 200 psi when using the conventional mixing gun shown in FIG. 2.. Below about 40 psi the process is very slow. At pressures above about 200 psi the glass beads may tend to break in the orifice of the mixing gun. A more preferred pressure is in the range of about 120 to 175 psi.

The glass beads are spherical and preferably solid. The diameter of the beads may range from about 0.002 to 0.01 inch. Preferably the diameter is about 0.006 inch. A mixture of sizes may also be used, of course. The specific gravity of the glass beads is preferably in the range of about 2.45 to 2.50.

The type of wood used in preferably pine because in such wood there is a significant difference between the hardness of the hard rings and the soft rings. Other types of wood have a distinct difference in ring hardness could also be used, of course.

Figure 1:
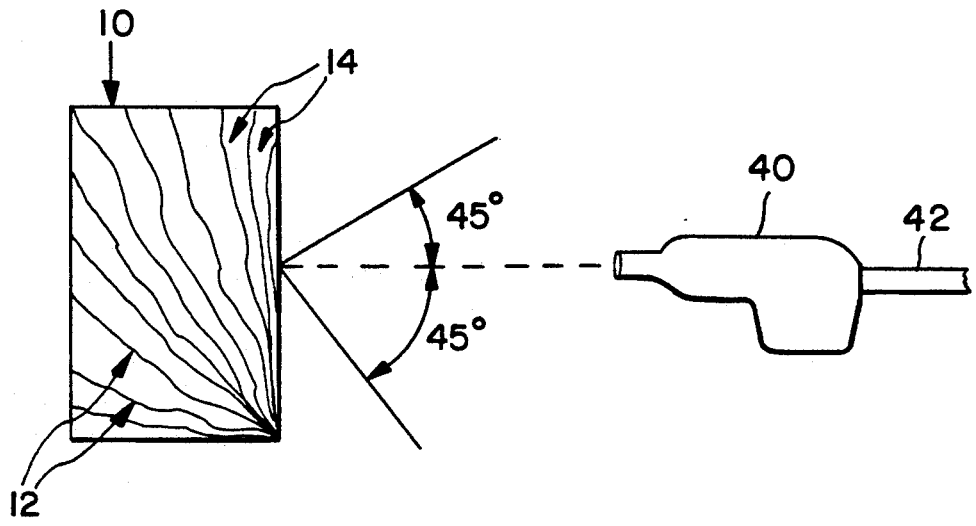
FIG. 1 is a side elevational view illustrating the preferred angles of impact of the glass beads on the wood to be treated.

As illustrated in FIG. 1, the glass beads should be directed at the surface of the wood within an angle of about 45° with respect to a line perpendicular to the surface of the wood. The gun may be held very close to the surface of the wood (e.g., one inch) or it may be held several inches away (e.g., 12 inches).

In the embodiment shown in FIG. 1, the gun 40 is connected to a supply line 42 for supplying both pressurized air and glass beads to the gun. This embodiment is useful when the glass beads and pressurized air are contained in a kettle or chamber and then are vented through line 42 to the nozzle or gun 40. For this type of apparatus, the air pressure may be in the range of about 7 to 200 psi.

The apparatus shown and described herein is commercially available, e.g., from Econoline Manufacturing, Inc.

Other variants are possible without departing from the scope of this invention.

What is claimed is:

1. A process for treating wood to simulate driftwood, wherein said wood includes a grain comprising hard rings separated by soft rings, the process comprising impacting said wood with glass beads at a speed and for a time sufficient to wear away said soft rings at a rate greater than said hard rings; wherein said glass beads are spherical and have a diameter in the range of about 0.002 to 0.01 inch; and wherein said glass beads have a specific gravity in the range of about 2.45 to 2.50.

2. A process in accordance with claim 1, wherein said glass beads are carried by pressurized air.

3. A process in accordance with claim 2, wherein said air is at a pressure in the range of about 40 to 200 psi.

4. A process in accordance with claim 1, wherein said glass beads are directed against said wood at an angle within about 45° relative to a line perpendicular to said wood.

5. A process for treating wood, wherein said wood includes a grain comprising hard rings separated by soft rings, the process comprising impacting said wood with glass beads at a speed and for a time sufficient to wear away said soft rings at a rate greater than said hard rings; wherein said glass beads have a diameter in the range of about 0.002 to 0.01 inch; and a specific gravity in the range of about 2.45 to 2.50; wherein said glass beads are directed against said wood at an angle within about 45° relative to a line perpendicular to said wood.

* * * * *